US011214752B2

(12) United States Patent
Csihony et al.

(10) Patent No.: US 11,214,752 B2
(45) Date of Patent: Jan. 4, 2022

(54) LUBRICANT COMPOSITION CONTAINING COPOLYMERS OF POLYISOBUTYLENEMETHACRYLATE

(71) Applicant: BASF SE, Ludwigshafen am Rhein (DE)

(72) Inventors: Szilard Csihony, Ludwigshafen am Rhein (DE); Anja Thomas, Ludwigshafen am Rhein (DE); Kevin J. Desantis, Tarrytown, NY (US); Philippe Rabbat, Tarrytown, NY (US); Andrea Misske, Ludwigshafen am Rhein (DE); Johannes Barth, Shanghai (CN); Meik Ranft, Ludwigshafen am Rhein (DE); Peter Mueller, Ludwigshafen am Rhein (DE); Wolfgang Grabarse, Ludwigshafen am Rhein (DE); Christoph Fleckenstein, Ludwigshafen am Rhein (DE)

(73) Assignee: BASF SE, Ludwigshafen am Rhein (DE)

( * ) Notice: Subject to any disclaimer, the term of this patent is extended or adjusted under 35 U.S.C. 154(b) by 41 days.

(21) Appl. No.: 16/622,474

(22) PCT Filed: Jul. 19, 2018

(86) PCT No.: PCT/EP2018/069650
§ 371 (c)(1),
(2) Date: Dec. 13, 2019

(87) PCT Pub. No.: WO2019/020491
PCT Pub. Date: Jan. 31, 2019

(65) Prior Publication Data

US 2021/0147759 A1 May 20, 2021

(51) Int. Cl.

| | |
|---|---|
| ***C10M 145/00*** | (2006.01) |
| ***C10M 145/14*** | (2006.01) |
| ***C10M 143/06*** | (2006.01) |
| ***C10M 169/04*** | (2006.01) |
| *C10N 20/00* | (2006.01) |
| *C10N 40/04* | (2006.01) |
| *C10N 30/00* | (2006.01) |
| *C10N 20/02* | (2006.01) |
| *C10N 30/02* | (2006.01) |
| *C10N 40/08* | (2006.01) |
| *C10N 40/20* | (2006.01) |
| *C10N 40/25* | (2006.01) |
| *C10N 50/10* | (2006.01) |

(52) U.S. Cl.
CPC ..... *C10M 145/14* (2013.01); *C10M 143/06* (2013.01); *C10M 169/047* (2013.01); *C10M 2205/022* (2013.01); *C10M 2205/024* (2013.01); *C10M 2205/026* (2013.01); *C10M 2209/084* (2013.01); *C10N 2020/02* (2013.01); *C10N 2020/071* (2020.05); *C10N 2030/02* (2013.01); *C10N 2030/68* (2020.05); *C10N 2040/042* (2020.05); *C10N 2040/044* (2020.05); *C10N 2040/08* (2013.01); *C10N 2040/20* (2013.01); *C10N 2040/25* (2013.01); *C10N 2050/10* (2013.01)

(58) Field of Classification Search
CPC ..... C10M 145/14; C10M 169/047; C10M 143/06; C10M 2209/084; C10M 2205/024; C10M 2205/026; C10M 2205/022; C10M 145/00; C10N 2020/071; C10N 2030/02; C10N 2040/25; C10N 2040/042; C10N 2050/10; C10N 2040/044; C10N 2030/68; C10N 2040/08; C10N 2040/20; C10N 2020/02
See application file for complete search history.

(56) References Cited

U.S. PATENT DOCUMENTS

| | | | |
|---|---|---|---|
| 3,149,178 | A | 9/1964 | Hamilton et al. |
| 3,382,291 | A | 5/1968 | Brennan |
| 5,478,875 | A | 12/1995 | Dubs et al. |
| 5,597,871 | A | 1/1997 | Auschra et al. |
| 6,497,812 | B1 | 12/2002 | Schinski |
| 6,875,897 | B1 | 4/2005 | Lange et al. |
| 8,067,349 | B2 | 11/2011 | Stoehr et al. |
| 8,513,172 | B2 | 8/2013 | Baum et al. |
| 2010/0190671 | A1 | 7/2010 | Stoehr et al. |
| 2015/0315309 | A1 | 11/2015 | Lange et al. |

(Continued)

FOREIGN PATENT DOCUMENTS

| | | | |
|---|---|---|---|
| EP | 0565487 | A2 | 10/1993 |
| EP | 3192857 | A1 | 7/2017 |

(Continued)

OTHER PUBLICATIONS

Covitch, M., et al., "How Polymers Behave as Viscosity Index Improvers in Lubricating Oils", Advances in Chemical Engineering and Science, vol. 5, No. 2, (2015), pp. 134-151.

(Continued)

*Primary Examiner* — Taiwo Oladapo

(74) *Attorney, Agent, or Firm* — Faegre Drinker Biddle & Reath LLP

(57) ABSTRACT

The present invention is directed to the use of poly(polyisobutylenemethacrylate) as viscosity index improving component in lubricating oil compositions. The invention is further related to lubricating oil compositions comprising poly(polyisobutylenemethacrylate) with enhanced shear stability.

17 Claims, No Drawings

(56) References Cited

U.S. PATENT DOCUMENTS

| | | | |
|---|---|---|---|
| 2017/0009177 | A1 | 1/2017 | Nakada et al. |
| 2019/0169346 | A1 | 6/2019 | Misske et al. |

FOREIGN PATENT DOCUMENTS

| | | | | |
|---|---|---|---|---|
| WO | WO-0226840 | A2 | 4/2002 | |
| WO | WO-14090672 | A1 | 6/2014 | |
| WO | WO-2015084643 | A2 * | 6/2015 | ..... C09J 4/06 |
| WO | WO2018024563 | A1 | 2/2018 | |

OTHER PUBLICATIONS

European Search Report for (Priority) Patent Application No. EP 17183659.6, dated Nov. 7, 2017.

Harrison, J., et al., "2D-Inadequate Structural Assignment of Polybutene Oligomers", Jounral of Organic Chemistry, vol. 62, No. 3, (1997), pp. 693-699.

International Search Report for PCT/EP2018/069650 dated Jul. 19, 2018.

Kennedy, J.P., et al., Macromers by Carbocationic Polymerization an Improved Synthesis of Polyisobutenylstyrene and Its Copolymerization with Methyl Methacrylate and Styrene, Polymer Preprints, vol. 23, No. 2, (1982), pp. 99-100.

Kennedy, J.P., et al., "Macromers by Carbocationic Polymerization. IV. Synthesis and Characterization of Polyisobutenyl Methacrylate Macromer and Its Homopolymerization and Copolymerization with Methyl Methacrylate", Journal of Polymer Science: Polymer Chemistry Edition, vol. 21, No. 4, (1983), pp. 1033-1044.

Kinker, B., "Chapter 11: Polymethacrylate Viscosity Modifiers and Pour Point Depressants", *Lubricant Additives: Chemistry and Applications*, 2nd ed.; CRC Press; Boca Raton, FL, 2009, pp. 315-337.

Liao, T.-P., et al., "New Telechelic Polymers and Sequential Copolymers by Polyfunctional Initiator-Transfer Agents (Inifers), 17. Synthesis and Characterization of Acryl and Methacryl Telechelic Polyisobutylenes (Polyisobutenyl Diacrylate and -dimethacrylate)", Polymer Bulletin, vol. 6, (1981), pp. 135-141.

Malins, E., et al., "Controlled Synthesis of Amphiphilic Block Copolymers Based on Poly(Isobutylene) Macromonomers", Journal of Polymer Science, Part A: Polymer Chemistry, vol. 54, No. 5, (2015), pp. 634-643.

Mary, C., et al., "New Insight into the Relationship Between Molecular Effects and the Rheological Behavior of Polymer-Thickened Lubricants Under High Pressure", Tribology Letters, vol. 52, No. 3, (2013), pp. 357-369.

Written Opinion of the International Searching Authority for PCT/EP2018/069650 dated Jul. 19, 2018.

* cited by examiner

LUBRICANT COMPOSITION CONTAINING COPOLYMERS OF POLYISOBUTYLENEMETHACRYLATE

CROSS-REFERENCE TO RELATED APPLICATIONS

This application is a national stage application (under 35 U.S.C. § 371) of PCT/EP2018/069650, filed Jul. 19, 2018, which claims benefit of European Application No. 17183659.6, filed Jul. 28, 2017, both of which are incorporated herein by reference in their entirety.

The invention is related to lubricant formulations, wherein the copolymer of polyisobutylene methacrylate is used as shear stable viscosity index improver.

BACKGROUND OF THE INVENTION

Polymethacrylates (PMA) are excellent viscosity index improvers in multigrade lubricating oils (L. R. Rudnick (ed) Lubricant Additives, Chemistry and Applications, CRC Press, Taylor & Francis Group, LLC, $2^{nd}$ ed., 2009, 315-338).

PMAs typically represent linear copolymers formed from two or three comonomer units: methacrylates with short, long, and eventually intermediate alkyl chains. Molecular weights vary from 20,000 to 300,000 g/mol. A major drawback is that the shear stability of the polymer decreases drastically with increasing molecular weight due to chain breakage under high shear.

Shear stability can be increased by modifying the topology of the polymer structure like comb or star structures or introducing longer or branched alkyl chains. The term branching is often also used in case of star or comb polymers.

Kennedy et all, J. Polym. Sci., 1983, 21, 1033-1044; Polym. Bull. 1981, 6, 135; Polym. Prep. Am. Chem. Soc. Div. Polym. Chem., 1982, 99, 23 describe polymers made of polyisobutylene (meth)acrylate macromonomers, which are formed by reaction of a polyisobutylene alcohols (PIBOH) and acryloyl chloride. PIBOH is obtained by oxidizing PIB in the presence of boron hydride.

U.S. Pat. No. 5,597,871 A describes copolymers made of polyolefin macromonomers and their application as viscosity index improvers in engine oil. One of the macromonomers is polyisobutylenemethacrylate, in this case PIBOH is made with the hydroformylation of polyisobutylene. PIBOH is then modified by transesterification with methyl methacrylate. Among others, copolymers of the macromonomer with styrene, butyl methacrylate, and isodecyl methacrylate are described.

U.S. Pat. No. 8,067,349 B2 describes similar copolymers with methacrylates and styrene and their application as viscosity index improvers in engine oil, too. The macromonomers are made of polyisobutylenes which are modified with hydroformylation to the corresponding alcohol or are further processed to form a polyisobutylene amine. Alternatively, alcohols can be obtained from the reaction with boron hydride. Macromonomers based on hydrogenated polybutadiene are described, as well.

US 20170009177 A1 describes copolymers based on macromonomers produced from polyisobutylene succinic anhydride (PIBSA) and their application as viscosity index improvers in lubricant oils. The macromonomers are made of polyisobutylenes which are modified with maleic anhydride in an ene-reaction. The obtained PIBSA is further reacted with 2-aminoethanol yielding a macroalcohol that is esterified with methacrylic acid to form a macromonomer.

US 2010/0190671 A1 describes copolymers of styrene and methacrylates with macromonomers from hydrogenated polybutadienes and their applications as viscosity index improvers in motor oil formulations.

U.S. Pat. No. 8,513,172 B2 describes star polymers of polymethacrylates that are made of coupling single chains produced by controlled radical polymerization.

Although macromonomers based on PIB and the use of their copolymers in lubricants were described in 1994 the macromonomer synthesis is the limited transformation of polyisobutylene in to its alcohol form. Polyisobutylenes contain 75-85% so called alpha olefin and 15-25% beta or less reactive olefins even if the best catalyst system as it is described in Harrison et all. J. Org. Chem., 1997, 62, 693 is used. Only the alpha olefins are reactive in hydroformylation, in oxidation of PIB with boron hydride, or in ene-reaction. Thus, the product mixture always contains 15-25% non-reacted polyisobutylene (PIB), which cannot be transformed in to macromonomers.

Low molecular weight polyisobutylenes with a weight average molecular weight of less than 2000 are used as effective thickeners in lubricant formulations. However, pure polyisobutylenes are not used as viscosity index improver (VII), as they do not change their size with increasing temperature such as polymethacrylates (Tribology Letters, 2013, 52, 357-369 and Advances in Chemical Engineering and Science, 2015, 5, 134-151). Unreacted polyisobutylene in viscosity index improvers made of comb polymers and macromonomers is therefore not desired.

Additionally, PIB is known to have bad shear stability. Thus, the benefit of high shear stability in comb-like structures is expected to be demolished by using PIB chains. Viscosity index depends also on molecular weight. The higher Mw is the higher the VI. It is also expected that high molecular weight polymers cannot be made of PIB, because the viscosity of the solution during the polymerization increases very fast due to its thickening character.

It was an object of the present invention to improve the shear stability of lubricant formulations containing polyisobutylene as viscosity index improver with excellent shear stability in lubricant formulations and to provide copolymers for the use in lubricant formulations with very high shear stability and a good viscosity index improvement.

The objective is solved by using copolymers of highly functionalized polyisobutylene macromonomers with alkyl methacrylate comonomers.

DESCRIPTION

The present invention provides the copolymer poly(polyisobutylenemethacrylate) in the following (polyPIBMA) from polyisobutylene macromonomers (PIBMA) with very low unreacted PIB residuals. The amount of unreacted PIB in the product mixture is below 10 weight %, preferably below 5 weight % most preferably below 2 weight % based on the product mixture. Unexpectedly, the copolymers (polyPIBMA) provided very high shear stability and surprisingly good viscosity index improvement in lubricant formulations that would not be expected for polyisobutylene based structures. The low residual PIB content is achieved by using PIB macromonomers with a high degree of functionality. These macromonomers are made with transformation of PIB to its alcohol form via Friedel-Crafts alkylation of phenol. To increase the hydrolytic stability of the methacrylic ester moiety, the resulting PIB-phenol is then reacted with ethylene carbonate to yield aliphatic PIB-alcohol with almost 100% functionality. The so produced PIB-alcohol is then transformed into the corresponding methacrylate ester (PIBMA) and copolymerized with other methacrylates.

The polyPIBMA comprises PIBMA of formula (I)

(I)

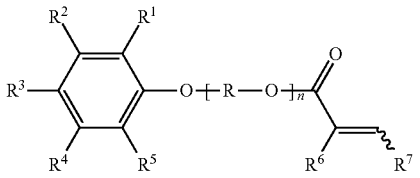

wherein $R^1$ to $R^5$ independently from each other are selected from the group consisting of hydrogen, $C_1$-$C_{20}$-alkyl, $C_1$-$C_{20}$-alkyloxy und $C_8$-$C_{7500}$-polyisobutyl und $C_8$-$C_{7500}$-polyisobutenyl, R is an alkylene group comprising 2 to 10, preferably 2 to 6 and most preferably 2 to 4 carbon atoms, $R^6$ is hydrogen or methyl (preferably methyl), $R^7$ is hydrogen or methyl, or $COOR^8$, $R^8$ is hydrogen or $C_1$-$C_{20}$-alkyl and n is a number from 1 to 50, characterized in that at least one of $R^1$ to $R^5$ is a $C_8$-$C_{7500}$-polyisobutyl or $C_8$-$C_{7500}$-polyisobutenyl.

Preferably, exactly one of $R^1$ to $R^5$ (preferably $R^3$) is a $C_8$-$C_{7500}$-polyisobutyl or $C_8$-$C_{7500}$-polyisobutenyl.

Preferably, the residues $R^1$ to $R^5$, which are not the $C_8$-$C_{7500}$-polyisobutyl or $C_8$-$C_{7500}$-polyisobutenyl, are selected from the group of hydrogen, methyl and tert-butyl.

Preferably, R is selected from 1,2-ethylene, 1,2-propylene, 1,2-butylene, 1-phenyl-1,2-ethylene, 2-phenyl-1,2-ethylene. In particular, R is selected from 1,2-ethylene and 1,2-propylene.

Preferably, n is 1.

Preferably, $R^7$ is hydrogen or $COOR^8$, wherein hydrogen is particular preferred.

Preferably, $R^8$ is hydrogen, methyl, ethyl, n-butyl, or 2-ethylhexyl, wherein hydrogen and methyl are more preferred.

The viscosity of a polymer component in mineral or synthetic lubricating oil formulations depends on the molecular weight. For instance, the viscosity index is typically improved by increasing the molecular weight of the polymeric component. On the other hand, higher molecular weights lead to decreased shear stabilities. An additional important factor is the thickening efficiency that depends on the structure and molecular weight of the additive. Accordingly, it is desirable to prepare polymeric components which can improve the viscosity index in lubricating oil compositions, provide good thickening, while excellent shear stability is obtained, as well.

In its most generic definition, the polymethacrylates (polyPIBMA) including polyisobutylene methacrylate (PIBMA) according to formula (I) of the present invention are defined as follows:

The polymers of alkyl esters of (meth)acrylic acid (polyPIBMA) are preferably those comprising 5-50% PIBMA according to formula (I) by weight, 0-50% of methyl(meth) acrylate and 0-80% (meth)acrylate with C2-C22 alkyl chains, preferably 10-35% PIBMA, 20-40% methyl (meth) acrylate, and 25-70% (meth)acrylate with C2-C22 alkyl chains, most preferably 10-20% PIBMA, 30-40% methyl (meth)acrylate, and 40-60% (meth)acrylate with C2-C22 alkyl chains.

In general, the C2-C22 (meth)acrylic acid esters employed are ethyl, n-propyl, i-propyl, n-butyl, i-butyl, sec-butyl, tert-butyl, pentyl, hexyl, heptyl, octyl, 2-ethylhexyl, 2-propyl heptyl, nonyl, decyl, stearyl, lauryl, octadecyl, heptadecyl, nonadecyl, eicosyl, henicosyl, docosyl, tricosyl, tetracosyl, pentacosyl, hexacosyl, heptacosyl, octacosyl, nonacosyl, triacontyl, behenyl methacrylate or acrylate, preferably n-butyl, 2-ethylhexyl, lauryl and stearyl, or mixtures of these monomers, most preferably lauryl.

The use of hydroxyl-, epoxy- and amino-functional methacrylates and acrylates is also possible.

The C2-C22 acrylates and methacrylates and mixtures thereof are generally employed in amounts in the range from 0 to 80 percent by weight, preferably from 40 to 70 percent by weight, based on the total amount of monomers of component.

As further comonomers, up to 50 percent by weight, preferably up to 20 percent by weight, of the following monomers, which are listed by way of example, can be employed: vinylaromatic compounds, such as styrene, alpha-methylstyrene, vinyltoluene or p-(tert-butyl) styrene; acrylic and methacrylic acid; acrylamide and methacrylamide; maleic acid and the imides and C1-C10-alkyl esters thereof; fumaric acid and the imides and C1-C10-alkyl esters thereof; itaconic acid and the imides and C1-C10-alkyl esters thereof; acrylonitrile and methacrylonitrile.

The polyPIBMA has preferably a number average carbon atoms (CNr) on the side chains of at least 6. The number average carbon atoms is calculated from the carbon atoms on the alkyl groups in the methacrylates. For example, if methyl methacrylate has 1 carbon atom in the alkyl groups, while lauryl methacrylate has 12, a polymer containing 50 mol % MMA and 50 mol % LMA according to the definition has a CNr of 6.5.

The copolymers of the present invention have a weight average molecular weight ranging from about 10,000 to about 800,000. Typically, the weight average may range from about 20,000 to about 500,000.

The molecular weight is determined by GPC using polystyrene standards (DIN 55672-1). The determined average molecular weight is therefore relative to the standard not absolute. In a particularly preferred embodiment, the copolymer is added to a lubricating oil composition in the form of a relatively concentrated solution of the copolymer in a diluent oil. The diluent oil may be any of the oils a diluent selected from base oils according to Group I to V, preferably the base oil is selected from Group I to III. Base oils are defined on page 11 ff of the application.

Another embodiment of the present invention is directed to a concentrated composition for use in lubricating oils comprising a diluent selected from base oils according to Group I to V, preferably the base oil is selected from Group I to III:

(i) a base oil (ii) from 10 to 80 percent by weight of the polyPIBMA as defined herein.

Another embodiment of the present invention is directed to a lubricating oil composition comprising base oils according to Group I to V, preferably the base oil is selected from Group I to III and additives:

(a) a base oil, (b) the polyPIBMA as defined herein, and (c) additives.

Another embodiment of the present invention is directed to the lubricating oil composition comprising a) 70 to 99.9 weight percent base oil, and b) 0.1 to 30 weight percent of the polyPIBMA and c) 0.05 to 20 weight percent of additives, more preferably, a) 75 to 99.0 weight percent base oil, b) 0.5 to 25.0 weight percent of the polyPIBMA and c) 0.1 to 15 weight percent of additives;

even more preferably, a) 80.0 to 95.0 weight percent base oil, b) 0.8 to 15.0 weight percent of the polyPIBMA and c) 0.5 to 8.0 weight percent of additives;

most preferably, a) 1.0 to 10.0 weight percent of the polyPIBMA, b) 85.0 to 90.0 weight percent base oil, and c) 0.8 to 5.0 weight percent of additives.

In another preferred embodiment of the lubricating oil composition, the composition comprises at least one additive selected from the group consisting of antioxidants, oxidation inhibitors, corrosion inhibitors, friction modifiers, metal passivators, rust inhibitors, anti-foamers, viscosity index enhancers, additional pour-point depressants, dispersants, detergents, extreme-pressure agents and/or anti-wear agents.

In another preferred embodiment of the lubricating oil composition, the lubricating oil composition has a viscosity loss at 100° C. according to ASTM D6278 (30 cycles) of less than 15%, preferably less than 10%, and more preferably less than 5%.

In another preferred embodiment of the lubricating oil composition, the composition has viscosity index (VI) as measured by DIN ISO 2909 of at least 180, preferably at least 185, more preferably at least 190.

Another embodiment of the present invention is directed to the use of the lubricating oil composition in an automatic transmission fluid, a manual transmission fluid, a hydraulic fluid, a grease, a gear fluid, a metal-working fluid, a crankcase engine oil or shock absorber fluid.

Another embodiment of the present invention is directed to a method for improving the shear stability of a lubricating oil composition, wherein said method comprises the step of adding to a base oil, and an optional additive, the polyPIBMA according to the present invention.

The polyPIBMA according to the present invention comprises a macromonomer which is a polyisobutylenemethacrylate (PIBMA) of formula (I).

The polyisobutylene macromonomers (PIBMA) of formula (I)

(I)

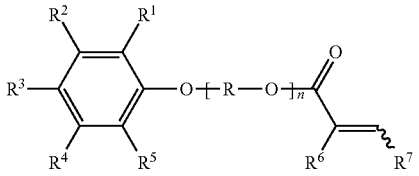

wherein $R^1$ to $R^5$ independently from each other are selected from the group consisting of hydrogen, $C_1$-$C_{20}$-alkyl, $C_1$-$C_{20}$-alkyloxy und $C_8$-$C_{7500}$-polyisobutyl und $C_8$-$C_{7500}$-polyisobutenyl, R is an alkylene group comprising 2 to 10, preferably 2 to 6 and most preferably 2 to 4 carbon atoms, $R^6$ is hydrogen or methyl, $R^7$ is hydrogen or methyl, or $COOR^8$, $R^8$ is hydrogen or $C_1$-$C_{20}$-alkyl and n is a number from 1 to 50, characterized in that at least one of $R^1$ to $R^5$ is a $C_8$-$C_{7500}$-polyisobutyl or $C_8$-$C_{7500}$-polyisobutenyl, are for example obtained by reacting free phenol of formula II (II)

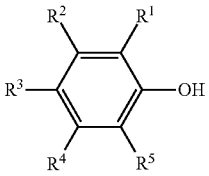

with alkylenoxides or alkylencarbonates of formula III (III)

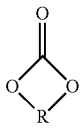

followed by a decarboxylation and subsequent esterification with (meth)acrylic acid and/or crotonic acid and/or fumaric acid and/or maleic acid or the respective anhydrides or by transesterification with esters of (meth) acrylic acid, crotonic acid, fumaric acid or maleic acid.

Free phenols are for example produced according to WO0226840 A2 and WO 14090672 A1.

The macromonomer PIBMA-s (PIBMA) have a relative weight average molecular weight ranging from about 100 to about 100,000. Typically, the relative weight average molecular weight is in the range of from about 500 to about 15,000, more preferably of from 800 to 10,000 and even more preferably from about 1,000 to 8,000.

The molecular weight distribution measured by GPC analysis (DIN 55672-1) using polystyrene standards is preferably less than 5.0 and generally ranges from about 1.2 to about 4.5, preferably from 1.3 to 4.0, and more preferably from 1.5 to 3.5.

The molecular weight is determined by GPC using polystyrene standards. The determined average molecular weight is therefore relative to the standard not absolute.

The polyPIBMA of the present invention have a relative weight average molecular weight ranging from about 10,000 to about 1,000,000. Typically, the relative weight average molecular weight is in the range of from about 15,000 to about 800,000, more preferably of from 20,000 to 600,000 and even more preferably from about 30,000 to 500,000. Some very preferred polymers of the present invention even have relative weight average molecular weight in the range of from 200,000 to 400,000 as determined by GPC analysis using polystyrene standard.

The kinematic viscosity of the polymer solution of the polyPIBMA of the present invention in base oil selected from Groups I to V at 100° C. is in the range of from 100 $mm^2/s$ to 2000 $mm^2/s$, preferably in the range of from 190 $mm^2/s$ to 1500 $mm^2/s$, more preferably in the range of from 400 $mm^2/s$ to 1200 $mm^2/s$, and most preferably in the range of from 500 $mm^2/s$ to 1000 $mm^2/s$, as measured with Brookfield viscometer.

Conventional methods of free-radical polymerization can be used to prepare the polyPIBMA copolymers of the present invention. Polymerization of the PIBMA macromonomer can take place under a variety of conditions, including bulk polymerization or solution polymerization, usually in an organic solvent, preferably mineral oil.

In the solution polymerization, the reaction mixture comprises a diluent, the macromonomer, a polymerization initiator and usually a chain transfer agent and optionally a crosslinker.

The diluent of the polymerization solution may be a base oil selected from Groups I to V, preferably a base oil selected from Groups I to III, most preferably an inert hydrocarbon. The concentration of macromonomers may range from about 1 to 99, preferably 2 to 20, most preferably 3 to 15 weight % based on the polymerization solution.

Suitable polymerization initiators include initiators which disassociate upon heating to yield a free radical, e.g., peroxide compounds such as benzoyl peroxide, t-butyl perbenzoate, t-butyl peroctoate and cumene hydroperoxide; and azo compounds such as azoisobutyronitrile and 2,2'-azobis (2-methylbutanenitrile). The mixture includes from about 0.001 wt percent to about 5.0 wt percent initiator relative to the total monomer mixture. For example, 0.02 weight percent to about 4.0 weight percent, 0.02 weight percent to about 3.5 weight percent are envisioned. Typically about 0.02 weight percent to about 2.0 weight percent are used.

Suitable chain transfer agents include those conventional in the art such as mercaptanes and alcohols. For example, tridecyl mercaptane, dodecyl mercaptane and ethyl mercaptane, but also bifunctional mercaptanes, such hexanedithiol may be used as chain transfer agents. The selection of the amount of chain transfer agent to be used is based on the desired molecular weight of the polymer being synthesized as well as the desired level of shear stability for the polymer, i.e., if a more shear stable polymer is desired, more chain transfer agent can be added to the reaction mixture. The chain transfer agent is added to the reaction mixture or monomer feed in an amount of 0.001 to 3 weight percent relative to the monomer mixture.

By way of example and without limitation, all components are charged to a reaction vessel that is equipped with a stirrer, a thermometer and a reflux condenser and heated with stirring under a nitrogen blanket to a temperature from about 50 degrees centigrade to about 125 degrees centigrade for a period of about 0.5 hours to about 15 hours to carry out the polymerization reaction.

A viscous solution of the copolymer of the present invention in the diluent is obtained as the product of the above-described process.

The present invention is also directed to a concentrate composition of the polyPIBMA of the present invention.

The concentrate composition is preferably intended for the use in lubricating oils. The concentrate composition can be diluted by the addition of further diluent, and, optionally by the addition of further additives thereby obtaining a lubricating oil composition from the concentrate composition according to the present invention.

The amount of the polyPIBMA in the concentrate composition is generally in the range of from 10 to 80 percent by weight, preferably from 10 to 70 percent by weight, more preferably from 15 to 60 percent by weight, and most preferably from 20 to 50 percent by weight based on the total weight of the concentrate composition.

Accordingly, to form the lubricating oils of the present invention, a base oil is treated or mixed with the polyPIBMA of the present invention in a conventional manner, i.e., by providing the polyPIBMA according to the present invention and adding it to the base oil with further optional additives to provide a lubricating oil composition having the desired technical specification and the required concentration of components.

In a particularly preferred embodiment, the polyPIBMA according to the present invention is added to the base oil in the form of a relatively concentrated solution of the polymer in a diluent. The diluent oil may be any of the oils referred to below that are suitable for use as base oils.

The present invention is also directed to lubricating oil compositions comprising polyPIBMA according to the present invention.

The amounts of the polyPIBMA of the present invention, the base oil component and the optional additive in the lubricating oil compositions are generally as follows:

In the most generic embodiment the amounts are from 0.1 to 30 weight percent of the polyPIBMA, from 70 to 99.9 weight percent base oil, and, from 0.05 to 10 weight percent of additives.

Preferably, the amounts are from 0.5 to 25.0 weight percent of the polyPIBMA, from 75 to 99.0 weight percent base oil, and, from 0.1 to 20 weight percent of additives.

More preferably, the amounts are from 0.8 to 15.0 weight percent of the polyPIBMA, from 80.0 to 95.0 weight percent base oil, and from 0.5 to 15.0 weight percent of additives.

Most preferably, the amounts are from 1.0 to 10.0 weight percent of the polyPIBMA, from 85.0 to 90.0 weight percent base oil, and from 0.8 to 15.0 weight percent of additives.

The weight ratio of the base oil component to the polyPIBMA of the present invention in the lubricating oil compositions according to the present invention is generally in the range of from 10 to 1000, more preferably from 20 to 500, even more preferably from 25 to 200, and most preferably from 30 to 150.

In another preferred embodiment of the present invention, the lubricating oil composition contains from about 0.1 to 10.0 parts by weight, preferably 0.2 to about 5.0 parts by weight, and more preferably about 0.5 to about 3.0 parts by weight, of the neat polymer (i.e. excluding diluent base oil) per 100 weight of base fluid. The preferred dosage will of course depend upon the base oil.

The lubricating oil compositions according to the present invention include at least one additive which is preferably selected from the group consisting of antioxidants, oxidation inhibitors, corrosion inhibitors, friction modifiers, metal passivators, rust inhibitors, anti-foamants, viscosity index enhancers, additional pour-point depressants, dispersants, detergents, further extreme-pressure agents and/or anti-wear agents. More preferred additives are described in more detail below.

The lubricating oil compositions according to the present invention are characterized by high shear stability as measured by the viscosity loss at 100° C. based on D62778 (30-cycles). The present invention has a shear loss generally less than 15%, preferably less than 10, and more preferably less than 5.

In addition or alternatively, the lubricating oil compositions according to the present invention further display high viscosity index (VI) as measured by DIN ISO 2909. Preferred viscosity index values of the lubricating oil compositions according to the present invention are at least 180, preferably at least 185, more preferably at least 190.

Additionally or alternatively, the lubricating oil compositions according to the present invention further display low viscosity in cold crankcase simulation (CCS) as measured by ASTM D5293. Preferred CCS values at −35° C. of the lubricating oil compositions according to the present invention are below 6500 mPas, preferably below 6400 mPas, more preferably below 6300 mPas.

Additionally or alternatively, treat rates of the lubricant oil compositions according to the present invention can preferably be in some selected embodiments in the range of from 0.5 to 30.0, preferably from 0.8 to 20.0, more preferably from 1.0 to 10.0 and most preferably from 1.0 to 8.0 weight percent.

In summary, the lubricating oil compositions provide excellent viscosity characteristics at low and high temperatures and when subjected to high shear stress.

To form the lubricating oils of the present invention, a base oil is treated with the copolymer of the invention in a conventional manner, i.e., by adding the copolymer to the base oil to provide a lubricating oil composition having the desired technical specification. The lubricating oil contains from about 0.1 to about 5.0 parts by weight, more typically about 1.0 to about 3.0, of the neat copolymer (i.e., excluding diluent oil) per 100 weight of base oil. The preferred dosage will of course depend upon the base oil.

Base Oils

The base oils are selected from the group consisting of Group I mineral oils, Group II mineral oils, Group III mineral oils and Group IV oils and Group V oils.

Definitions for the base oils according to the present invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base oils contain less than 90 percent saturates and/or greater than 0.03 percent sulfur and have a viscosity index greater than or equal to 80 and less than 120 using the test methods specified in the following table.

Group I base oils can comprise light overhead cuts and heavier side cuts from a vacuum distillation column and can also include, for example, Light Neutral, Medium Neutral, and Heavy Neutral base stocks. The petroleum derived base oil also may include residual stocks or bottoms fractions, such as, for example, bright stock. Bright stock is a high viscosity base oil which has been conventionally produced from residual stocks or bottoms and has been highly refined and dewaxed. Bright stock can have a kinematic viscosity greater than about 180 cSt at 40° C., or even greater than about 250 cSt at 40° C., or even ranging from about 500 to about 1100 cSt at 40° C.

In an embodiment, the one or more base oils can be a blend or mixture of one or more than one Group I base oils having different molecular weights and viscosities, wherein the blend is processed in any suitable manner to create a base oil having suitable properties (such as the viscosity and TBN values, discussed above) for use in a marine diesel engine.

b) Group base oils contain greater than or equal to 90 percent saturates and less than or equal to 0.03 percent sulfur and have a viscosity index greater than or equal to 80 and less than 120 using the test methods specified in the following table.

c) Group III base oils contain greater than or equal to 90 percent saturates and less than or equal to 0.03 percent sulfur and have a viscosity index greater than or equal to 120 using the test methods specified in the following table.

Group III base oils derived from petroleum oils are severely hydrotreated mineral oils. Hydrotreating involves reacting hydrogen with the basestock to be treated to remove heteroatoms from the hydrocarbon, reduce olefins and aromatics to alkanes and cycloparaffins respectively, and in very severe hydrotreating, open up naphthenic ring structures to non-cyclic normal and iso-alkanes ("paraffins").

Analytical Methods for Base oils:

| Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

d) Group IV base oils contain polyalphaolefins. Synthetic lower viscosity fluids suitable for the present invention include the polyalphaolefins (PAOs) and the synthetic oils from the hydro-cracking or hydro-isomerization of Fischer Tropsch high boiling fractions including waxes. These are both base oils comprised of saturates with low impurity levels consistent with their synthetic origin. The hydro-isomerized Fischer Tropsch waxes are highly suitable base oils, comprising saturated components of isoparaffinic character (resulting from the isomerization of the predominantly n-paraffins of the Fischer Tropsch waxes) which give a good blend of high viscosity index and low pour point.

Polyalphaolefins suitable for the lubricant compositions according to the present invention, include known PAO materials which typically comprise relatively low molecular weight hydrogenated polymers or oligomers of alphaolefins which include but are not limited to $C_2$ to about $C_{32}$ alphaolefins with the $C_8$ to about $C_{16}$ alphaolefins, such as 1-octene, 1-decene, 1-dodecene and the like being preferred. The preferred polyalphaolefins are poly-1-octene, poly-1-decene, and poly-1-dodecene, although the dimers of higher olefins in the range of $C_{14}$ to $C_{18}$ provide low viscosity base stocks.

Terms like PAO 2, PAO 4, PAO 6 or PAO 8 are commonly used specifications for different classes of polyalphaolefins characterized by their respective viscosity. For instance, PAO 2 refers to the class of polyalphaolefins which typically has viscosity in the range of 2 $mm^2/s$ at 100° C. A variety of commercially available compositions are available for these specifications.

Low viscosity PAO fluids suitable for the lubricant compositions according to the present invention, may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example, the methods disclosed by U.S. Pat. No. 3,149,178 or 3,382,291 may be conveniently used herein.

e) Group V base oils contain any base stocks not described by Groups I to IV. Examples of Group V base oils include alkyl naphthalenes, alkylene oxide polymers, silicone oils, and phosphate esters.

Synthetic base oils include hydrocarbon oils and halo-substituted hydrocarbon oils such as polymerized and interpolymerized olefins (e.g., polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic base oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of polyethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Silicon-based oils such as the polyalkyl-, polyaryl-, polyalkoxy- or polyaryloxysilicone oils and silicate oils comprise another useful class of synthetic base oils; such base oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane and poly(methylphenyl)siloxanes. Other synthetic base oils include liquid esters of phosphorous-containing acids (e.g., tricresyl phosphate, trioctyl phosphate, diethyl ester of decylphosphonic acid) and polymeric tetrahydrofurans.

Preferred base oils contemplated for use in this invention include mineral oils, polyalphaolefin synthetic oils and mixtures thereof. Suitable base oils also include basestocks obtained by isomerization of synthetic wax and slack wax, as well as basestocks produced by hydrocracking (rather than solvent extracting) the aromatic and polar components of the crude. In general, both the mineral and synthetic base oils will each have a kinematic viscosity ranging from about 1 to about 40 cSt at 100 degrees centigrade, although typical applications will require each oil to have a viscosity ranging from about 1 to about 10 cSt at 100 degrees centigrade.

The mineral oils useful in this invention include all common mineral oil base stocks. This would include oils that are naphthenic, paraffinic or aromatic in chemical structure. Naphthenic oils are made up of methylene groups arranged in ring formation with paraffinic side chains attached to the rings. The pour point is generally lower than the pour point for paraffinic oils. Paraffinic oils comprise saturated, straight chain or branched hydrocarbons. The straight chain paraffins of high molecular weight raise the pour point of oils and are often removed by dewaxing. Aromatic oils are hydrocarbons of closed carbon rings of a semi-unsaturated character and may have attached side chains. This oil is more easily degraded than paraffinic and naphthalenic oils leading to corrosive by-products.

In reality a base stock will normally contain a chemical composition which contains some proportion of all three (paraffinic, naphthenic and aromatic).

The homopolymer may be used in paraffinic, naphthenic and aromatic type oils. For example, the homopolymer may be used in Groups I-V base oils. These Groups are well known by those skilled in the art. Additionally, the homopolymer may be used in gas to liquid oils.

Gas to liquid oils (GTL) are well known in the art. Gaseous sources include a wide variety of materials such as natural gas, methane, C1-C3 alkanes, landfill gases, and the like. Such gases may be converted to liquid hydrocarbon products suitable for use as lubricant base oils by a gas to liquid (GTL) process, such as the process described in U.S. Pat. No. 6,497,812, the disclosure of which is incorporated herein by reference.

Base oils derived from a gaseous source, hereinafter referred to as "GTL base oils", typically have a viscosity index of greater than about 130, a sulfur content of less than about 0.3 percent by weight, contain greater than about 90 percent by weight saturated hydrocarbons (isoparaffins), typically from about 95 to about 100 weight percent branched aliphatic hydrocarbons, have a pour point of below −15 to −20 C.

The GTL base oils may be mixed with more conventional base oils such as Groups I to V as specified by API. For example, the base oil component of the lubricant compositions may include 1 to 100 percent by weight to a GTL base oil.

Thus a lubricating oil composition may be at least partially derived from a gaseous source and contain the instant polymethacrylate ester as a pour point depressant.

Oils may be refined by conventional methodology using acid, alkali, and clay or other agents such as aluminum chloride, or they may be extracted oils produced, for example, by solvent extraction with solvents such as phenol, sulfur dioxide, furfural, dichlorodiethyl ether, etc. They may be hydrotreated or hydrorefined, dewaxed by chilling or catalytic dewaxing processes, or hydrocracked. The mineral oil may be produced from natural crude sources or be composed of isomerized wax materials or residues of other refining processes. The preferred synthetic oils are oligomers of alpha-olefins, particularly oligomers of 1-decene, also known as polyalphaolefins or PAO's.

The base oils may be derived from refined, re-refined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Re-refined oils are obtained by treating used oils in processes similar to those used to obtain the refined oils. These re-refined oils are also known as reclaimed or reprocessed oils and are often additionally processed by techniques for removal of spent additives and oils breakdown products.

Optional Customary Oil Additives

The addition of at least one additional customary oil additive to the composition is possible. The mentioned lubricant compositions, e.g. greases, gear fluids, metal-working fluids and hydraulic fluids, may additionally comprise further additives that are added in order to improve their basic properties still further. Such additives include: further antioxidants, metal passivators, rust inhibitors, viscosity index enhancers, additional pour-point depressants, dispersants, detergents, further extreme-pressure additives and anti-wear additives. Such additives are added in the amounts customary for each of them, which range in each case approximately from 0.01 to 10.0 percent, preferably 0.1 to 1.0 percent, by weight. Examples of further additives are given below:

1. Examples of Phenolic Antioxidants:

1.1. Alkylated monophenols: 2,6-di-tert-butyl-4-methylphenol, 2-butyl-4,6-dimethylphenol, 2,6-ditert-butyl-4-ethylphenol, 2,6-di-tert-butyl-4-n-butylphenol, 2,6-di-tert-butyl-4-isobutylphenol, 2,6-dicyclopentyl-4-methylphenol, 2-(alpha-methylcyclohexyl)-4,6-dimethylphenol, 2,6-dioctadecyl-4-methylphenol, 2,4,6-tricyclohexylphenol, 2,6-di-tert-butyl-4-methoxymethylphenol, linear nonylphenols or nonylphenols branched in the side chain, such as, for example, 2,6-dinonyl-4-methylphenol, 2,4-dimethyl-6-(1'-methyl-undec-1'-yl)-phenol, 2,4-dimethyl-6-(1'-methylheptadec-1'-yl)-phenol, 2,4-dimethyl-6-(1'-methyltridec-1'-yl)-phenol and mixtures thereof;

1.2. Alkylthiomethylphenols: 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol;

1.3. Hydroquinones and alkylated hydroquinones: 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-ditert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis(3,5-di-tert-butyl-4-hydroxyphenyl) adipate;

1.4. Tocopherols: alpha-, beta-, gamma-, or delta-tocopherol and mixtures thereof (vitamin E);

1.5. Hydroxylated thiodiphenyl ethers: 2,2'-thio-bis(6-tert-butyl-4-methylphenol), 2,2'-thio-bis(4-octylphenol), 4,4'-thio-bis(6-tert-butyl-3-methylphenol), 4,4'-thio-bis(6-tert-butyl-2-methylphenol), 4,4'-thio-bis(3,6-di-sec-amylphenol), 4,4'-bis(2,6-dimethyl-4-hydroxy-phenyl)disulfide;

1.6. Alkylidene bisphenols: 2,2'-methylene-bis(6-tert-butyl-4-methylphenol), 2,2'-methylenebis(6-tert-butyl-4-ethylphenol), 2,2'-methylene-bis[4-methyl-6-(alpha-methylcyclohexyl)phenol], 2,2'-methylene-bis(4-methyl-6-cyclohexylphenol), 2,2'-methylene-bis(6-nonyl-4-methylphenol), 2,2'-methylene-bis(4,6-di-tert-butylphenol), 2,2'-ethylidene-bis(4,6-di-tert-butylphenol), 2,2'-ethylidene-bis(6-tert-butyl-4-isobutylphenol), 2,2'-methylene-bis[6-(alpha-methylbenzyl)-4-nonylphenol], 2,2'-methylene-bis[6-(alpha, alpha-dimethyl-benzyl)-4-nonylphenol], 4,4'-methylenebis(2,6-di-tert-butylphenol), 4,4'-methylene-bis (6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methylphenyl)-3-n-dodecylmercaptobutane, ethylene glycol bis[3,3-bis(3'-tert-butyl-4'-hydroxyphenyl)-butyrate], bis(3-tert-butyl-4-hydroxy-5-methylphenyl)dicyclopentadiene, bis[2-(3'-tertbutyl-2'-hydroxy-5'-methylbenzyl)-6-tert-butyl-4-methylphen yl]terephthalate, 1,1-bis(3,5-dimethyl-2-hydroxyphenyl)butane, 2,2-bis(3,5-di-tert-butyl-4-hydroxyphenyl)-propane, 2,2-bis(5-tert-butyl-4-hydroxy-2-methylphenyl)-4-n-dodecylmercaptobutane, 1,1,5,5-tetra(5-tert-butyl-4-hydroxy-2-methylphenyl)pentane;

1.7. O-. N- and S-benzyl compounds: 3,5,3',5'-tetra-tert-butyl-4,4'-dihydroxydibenzyl ether, octadecyl-4-hydroxy-3,5-dimethylbenzyl-mercaptoacetate, tridecyl-4-hydroxy-3,5-di-tert-butylbenzyl-mercaptoacetate, tris(3,5-di-tert-butyl-4-hydroxybenzyl)amine, bis(4-tert-butyl-3-hydroxy-2,6-dimethylbenzyl)dithioterephthalate, bis(3,5-di-tert-butyl-4-hydroxybenzyl)sulfide, isooctyl-3,5-di-tert-butyl-4-hydroxybenzyl-mercaptoacetate;

1.8. Hydroxybenzylated malonates: dioctadecyl-2,2-bis (3,5-di-tert-butyl-2-hydroxybenzyl) malonate, dioctadecyl-2-(3-tert-butyl-4-hydroxy-5-methylbenzyl)malonate, didodecyl-mercaptoethyl-2,2-bis(3,5-di-tert-butyl-4-hydroxybenzyl) malonate, di[4-(1,1,3,3-tetramethylbutyl)-phenyl]-2,2-bis(3,5-di-tert-butyl-4-hydroxybenzyl) malonate;

1.9. Hydroxybenzyl aromatic compounds: 1,3,5-tris(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl) phenol;

1.10. Triazine compounds: 2,4-bis-octylmercapto-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl)isocyanurate, 2,4,6-tris(3,5-di-tert-butyl-4-hydroxyphenylethyl)-1,3,5-triazine, 1,3,5-tris(3,5-di-tert-butyl-4-hydroxyphenylpropionyl) hexahydro-1,3,5-triazine, 1,3,5-tris(3,5-dicyclohexyl-4-hydroxybenzyl)isocyanurate;

1.11. Acylaminophenols: 4-hydroxylauric acid anilide, 4-hydroxystearic acid anilide, N-(3,5-ditert-butyl-4-hydroxyphenyl)-carbamic acid octyl ester;

1.12. Esters of beta-(5-tert-butyl-4-hydroxy-3-methylphenyl) propionic acid: with polyhydric alcohols, e.g. with 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl) oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]octane;

1.13. Esters of beta-(3,5-di-tert-butyl-4-hydroxyphenyl) propionic acid, gamma-(3,5-dicyclohexyl-4-hydroxyphenyl) propionic acid, 3,5-di-tert-butyl-4-hydroxyphenylacetic acid: with mono- or polyhydric alcohols, e.g., with methanol, ethanol, n-octanol, isooctanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis-hydroxyethyl oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]octane;

1.14. Amides of beta-(3,5-di-tert-butyl-4-hydroxyphenyl) propionic acid: N,N'-bis(3,5-di-tertbutyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl) hydrazine;

1.15. Ascorbic acid (vitamin C);

1.16. Aminic antioxidants: N,N'-diisopropyl-p-phenylenediamine, N,N'-di-sec-butyl-p-phenylenediamine, N,N'-bis(1,4-dimethylpentyl)-p-phenylenediamine, N,N'-bis (1-ethyl-3-methylpentyl)-p-phenylenediamine, N,N'-bis(1-methylheptyl)-p-phenylenediamine, N,N'dicyclo-hexyl-p-phenylenediamine, N,N'-diphenyl-p-phenylenediamine, N,N'-di(naphth-2-yl)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfonamido)-diphenylamine, N,N'-dimethyl-N,N'-di-sec-butyl-p-phenylenediamine, diphenylamine, N-allyldiphenylamine, 4-isopropoxy-diphenylamine, 4-n-butylaminophenol, 4-butyrylaminophenol, 4-nonanoylaminophenol, 4-dodecanoylaminophenol, 4-octadecanoylamino-phenol, di(4-methoxyphenyl)amine, 2,6-di-tert-butyl-4-dimethylaminomethyl phenol, 2,4'-diaminodiphenylmethane, 4,4'-diaminodi-phenylmethane, N,N,N',N'-tetramethyl-4,4'-diaminodiphenylmethane, 1,2-di[(2-methyl-phenyl)amino]-ethane, 1,2-di(phenylamino)propane, (o-tolyl)biguanide, di[4-(1',3'-dimethyl-butyl)phenyl]amine, tert-octylated N-phenyl-1-naphthylamine, mixture of mono- and di-alkylated tert-butyl/tert-octyl-diphenylamines, mixture of mono- and di-alkylated nonyldiphenylamines, mixture of mono- and di-alkylated dodecyldiphenylamines, mixture of mono- and di-alkylated isopropyl/isohexyl-diphenylamines, mixtures of mono- and di-alkylated tert-butyldiphenylamines, 2,3-dihydro-3,3-dimethyl-4H-1,4-benzothiazine, phenothiazine, mixture of mono- and di-alkylated tert-butyl/tert-octyl-phenothiazines, mixtures of mono- and di-alkylated tert-octylphenothiazines, N-allylphenothiazine, N,N,N',N'-tetraphenyl-1,4-diaminobut-2-ene, N,N-bis(2,2,6,6-tetramethylpiperidin-4-yl)hexamethylenediamine, bis(2,2,6,6-tetramethylpiperidin-4-yl)sebacate, 2,2,6,6-tetramethylpiperidin-4-one, 2,2,6,6-tetramethylpiperidin-4-ol.

2. Examples of further antioxidants: aliphatic or aromatic phosphites, esters of thiodipropionic acid or thiodiacetic acid or salts of dithiocarbamic acid, 2,2,12,12-tetramethyl-5,9-dihydroxy-3,7,11-trithiamidecane and 2,2,15,15-tetramethyl-5,12-dihydroxy-3,7,10,14-tetrathiahexa-decane.

3. Examples of Metal Deactivators. e.g. for Copper:

3.1. Benzotriazoles and derivatives thereof: 2-mercaptobenzotriazole, 2,5-dimer-captobenzotriazole, 4- or 5-alkylbenzotriazoles (e.g. tolutriazole) and derivatives thereof, 4,5,6,7-tetrahydrobenzotriazole, 5,5'-methylene-bis-benzotriazole; Mannich bases of benzotriazole or tolutriazole, such as 1-[di(2-ethylhexyl)aminomethyl]tolutriazole and 1-[di(2-ethylhexyl)aminomethyl]benzotriazole; alkoxyalkylbenzotriazoles, such as 1-(nonyloxymethyl)benzotriazole, 1-(1-butoxyethyl)-benzotriazole and 1-(1-cyclohexyloxybutyl)-tolutriazole;

3.2. 1,2,4-Triazoles and derivatives thereof: 3-alkyl-(or -aryl-) 1,2,4-triazoles, Mannich bases of 1,2,4-triazoles, such as 1-[di(2-ethylhexyl)aminomethyl]-1,2,4-triazole; alkoxyalkyl-1,2,4-triazoles, such as 1-(1-butoxyethyl)-1,2,4-triazole; acylated 3-amino-1,2,4-triazoles;

3.3. Imidazole derivatives: 4,4'-methylene-bis(2-undecyl-5-methyl) imidazole and bis[(N-methyl)imidazol-2-yl]carbinol-octyl ether;

3.4. Sulfur-containing heterocyclic compounds: 2-mercaptobenzothiazole, 2,5-dimercapto-1,3,4-thiadiazole, 2,5-dimercaptobenzothiadiazole and derivatives thereof; 3,5-bis[di(2-ethylhexyl)aminomethyl]-1,3,4-thiadiazolin-2-one;

3.5. Amino compounds: salicylidene-propylenediamine, salicylaminoguanidine and salts thereof.

4. Examples of Rust Inhibitors:

4.1. Organic acids, their esters, metal salts, amine salts and anhydrides: alkyl- and alkenylsuccinic acids and their partial esters with alcohols, diols or hydroxycarboxylic acids, partial amides of alkyl- and alkenyl-succinic acids, 4-nonylphenoxyacetic acid, alkoxy- and alkoxyethoxy-carboxylic acids, such as dodecyloxyacetic acid, dodecyloxy(ethoxy)acetic acid and amine salts thereof, and also N-oleoyl-sarcosine, sorbitan monooleate, lead naphthenate, alkenylsuccinic acid anhydrides, e.g. dodecenylsuccinic acid anhydride, 2-(2-carboxyethyl)-1-dodecyl-3-methylglycerol and salts thereof, especially sodium and triethanolamine salts thereof.

4.2. Nitrogen-Containing Compounds:

4.2.1. Tertiary aliphatic or cycloaliphatic amines and amine salts of organic and inorganic acids, e.g. oil-soluble alkylammonium carboxylates, and 1-[N,N-bis(2-hydroxyethyl)amino]-3-(4-nonylphenoxy)propan-2-ol;

4.2.2. Heterocyclic compounds: substituted imidazolines and oxazolines, e.g. 2-heptadecenyl-1-(2-hydroxyethyl)-imidazoline;

4.2.3. Sulfur-containing compounds: barium dinonyinaphthalene sulfonates, calcium petroleum sulfonates, alkylthio-substituted aliphatic carboxylic acids, esters of aliphatic 2-sulfocarboxylic acids and salts thereof.

5. Examples of additional viscosity index enhancers: polyacrylates, polymethacrylates, nitrogen containing polymethylmethacrylates, vinylpyrrolidone/methacrylate homopolymers, polyvinylpyrrolidones, polybutenes, polyisobutylenes, olefin homopolymers such as ethylene-propylene homopolymers, styrene-isoprene homopolymers, hydrated styrene-isoprene homopolymers, styrene/acrylate homopolymers and polyethers. Multifunctional viscosity improvers, which also have dispersant and/or antioxidancy properties are known and may optionally be used in addition to the products of this invention.

6. Examples of pour-point depressants: polymethacrylates, ethylene/vinyl acetate homopolymers, alkyl polystyrenes, fumarate homopolymers, alkylated naphthalene derivatives.

7. Examples of dispersants/surfactants: polybutenylsuccinic acid amides or imides, poly-butenylphosphonic acid derivatives, basic magnesium, calcium and barium sulfonates and phenolates.

8. Examples of extreme-pressure and anti-wear additives: sulfur- and halogen-containing compounds, e.g. chlorinated paraffins, sulfurized olefins or vegetable oils (soybean oil, rape oil), alkyl- or aryl-di- or -tri-sulfides, benzotriazoles or derivatives thereof, such as bis(2-ethylhexyl)aminomethyl tolutriazoles, dithiocarbamates, such as methylene-bis-dibutyldithiocarbamate, derivatives of 2-mercaptobenzothiazole, such as 1-[N,N-bis(2-ethylhexyl)aminomethyl]-2-mercapto-1H-1,3-benzothiazole, derivatives of 2,5-dimercapto-1,3,4-thiadiazole, such as 2,5-bis(tert-nonyidithio)-1,3,4-thiadiazole.

9 Examples of coefficient of friction reducers: lard oil, oleic acid, tallow, rape oil, sulfurized fats, amides, amines. Further examples are given in EP-A-0 565 487.

10. Examples of special additives for use in water/oil metal-working fluids and hydraulic fluids: Emulsifiers: petroleum sulfonates, amines, such as polyoxyethylated fatty amines, non-ionic surface-active substances; buffers: such as alkanolamines; biocides: triazines, thiazolinones, tris-nitromethane, morpholine, sodium pyridenethiol; processing speed improvers: calcium and barium sulfonates.

The inventive poly(meth)acrylate viscosity index improver may be admixed with the abovementioned directly in a lubricant. It is also possible to prepare a concentrate or a so-called "additive pack", which can be diluted to give the working concentrations for the intended lubricant.

Lubricating oils containing the copolymers of the present invention may be used in a number of different applications including automatic transmission fluids, manual transmission fluids, hydraulic fluids, greases, gear fluids, metal-working fluids, engine oil applications and shock absorber fluids.

EXAMPLES

Measurement of the relative weight average molecular weight and molecular weight distribution of polymers has been determined based on GPC measurements using polystyrene standards (DIN 55672-1).

Viscosity index (VI) has been determined based on DIN ISO 2909.

Shear stability has been determined based on the viscosity loss of the formulation at 100° C. which has been measured based on ASTM D6278—30 cycles.

Example 1: Polymerization of PIBMA 15 g PIBMA made of polyisobutylene with an $M_n$ of 1000 g/mol (prepared by reaction of ethylene carbonate and a phenol-bearing polyisobutylene, and subsequent treatment of with methylacrylic anhydride, according to Example 3 of WO 2018/024563), 97.5 g laurylmethacrylate (LMA), 37.5 g methylmethacrylate (MMA) and 100 mg dodecylmercaptane as 10% Nexbase 3030 (group III base oil) solution were mixed in 214 g Nexbase 3030 base oil in 1 L 4-neck flask. The mixture was heated up to 95° C. resulting in a colorless, clear solution. A solution of 0.54 g tert-butylperoctoate in 5.5 g Nexbase 3030 is prepared and continuously fed to the flask within 2 h. Another solution of 0.54 g tert-butylperoctoate in 5.5 g Nexbase 3030 is fed to the mixture in 15 min. After the addition of initiator solution the mixture is stirred for another hour at 95° C. and 130° C. for 30 min. Finally, 125 g Nexbase is added to afford a 30% solution of the polymer. The solution is allowed to cool down to room temperature forming a colorless, viscous liquid.

The CNr (number average carbon atoms) of the polymer is 7.8.

The kinematic viscosity of 367.7 $mm^2/s$ (cSt) has been determined using Brookfield viscometer at 100° C. (KV100), and 21386 $mm^2/s$ at 40° C. (KV40).

The 30% mixture is diluted further to 5% with Nexbase 3030 and the viscosities at 40 and 100° C. are measured, obtaining KV100 of 7.2 and KV40 of 20.6 mm2/s: VI=359.

A dilution to 2.5% affords KV100 of 4.5 and KV40 of 14.1 mm2/s: VI=272.

GPC analysis according to DIN 55672-1 (polystyrene standard): detector: DRI Agilent 1100 UV Agilent 1100 VWD [254 nm], eluent: tetrahydrofuran+0.1% trifluoracetic acid eluent, flow rate: 1 ml/min), concentration: 2 mg/ml, column: PLgel MIXED-B.

$M_w$=305 000 g/mol, PDI=7.3.

Polymers containing PIBMA, MMA, LMA, or butyl methacrylate (BMA) were prepared varying monomer composition, tert-butylperoctoate and dodecylmercaptane amount. Two PIBMA derivatives were tested. One was made of PIB having an $M_n$ of 1000 g/mol (PIB1000MA) and another one having $M_n$ of 2300 g/mol (PIB2300MA). The reaction temperature and solvent were kept constant. The viscosity of the solutions at 100° C. was measured (KV100) and the polymers analyzed by GPC. The obtained polymers are summarized in Tables 1 to 3.

Comparable examples are comprising a CNr below 6 and are summarized in Table 1. It can be seen that due to the inhomogeneity the kinematic viscosity and PDI cannot be determined.

TABLE 1

Comparative Polymers CP1 to CP4

| polymer # | PIB1000MA/g | MMA/g | BMA/g | CNr | KV100/cSt | Mw/g/mol | PDI | Conc/% |
|---|---|---|---|---|---|---|---|---|
| CP1 | 30 | 30 | 90 | 4.8 | inhomogeneous | | | 30 |
| CP2 | 40 | 20 | 90 | 5.9 | inhomogeneous | | | 25 |
| polymer # | PIB2300MA/g | MMA/g | BMA/g | CNr | KV100/cSt | Mw/g/mol | PDI | Conc/% |
| CP3 | 15 | 45 | 90 | 3.6 | inhomogeneous | | | 30 |
| CP4 | 30 | 45 | 75 | 4.6 | inhomogeneous | | | 30 |

Examples according to the invention are shown in Table 2:

TABLE 2

| polymer # | PIB1000MA/g | MMA/g | LMA/g | CNr | KV100/cSt | Mw/g/mol | PDI | Conc/% |
|---|---|---|---|---|---|---|---|---|
| P1 | 45 | 45 | 60 | 8.4 | 1443 | 415 000 | 14.1 | 30 |
| P2 | 30 | 30 | 90 | 9.6 | 322 | 403 000 | 11.6 | 30 |
| P3 | 30 | 45 | 75 | 7.7 | 877 | 368 000 | 9.7 | 30 |
| P4 | 15 | 30 | 105 | 8.7 | 182 | 259 000 | 6.7 | 30 |
| P5 | 15 | 37.5 | 97.5 | 7.8 | 398 | 305 000 | 7.3 | 30 |
| P6 | 15 | 37.5 | 97.5 | 7.8 | 304 | 281 000 | 7.0 | 30 |
| P7 | 15 | 37.5 | 97.5 | 7.8 | 217 | 247 000 | 7.7 | 30 |
| P8 | 15 | 20 | 115 | 10.1 | 221 | 293 000 | 7.5 | 30 |
| polymer # | PIB2300MA/g | MMA/g | BMA/g | CNr | KV100/cSt | Mw/g/mol | PDI | Conc/% |
| P9 | 60 | 30 | 60 | 8.0 | 298 | 299 000 | 11.7 | 30 |
| P10 | 50 | 20 | 80 | 7.3 | NA | 144 000 | 5.7 | 40 |
| P11 | 50 | 20 | 80 | 7.3 | NA | 195 000 | 7.5 | 30 |

TABLE 2-continued

| polymer # | PIB2300MA/g | MMA/g | LMA/g | CNr | KV100/cSt | Mw/g/mol | PDI | Conc/% |
|---|---|---|---|---|---|---|---|---|
| P12 | 30 | 37.5 | 82.5 | 9.0 | 1322 | 480 000 | 13.4 | 30 |
| P13 | 30 | 30 | 90 | 10.0 | 673 | 494 000 | 13.0 | 30 |
| P14 | 15 | 37.5 | 97.5 | 7.7 | 649 | 367 000 | 7.2 | 30 |
| P15 | 15 | 30 | 105 | 7.7 | 326 | 342 000 | 8.2 | 30 |
| P16 | 15 | 20 | 115 | 8.9 | 353 | 425 000 | 8.2 | 30 |

A comparative linear polymer was made according to European application EP 3192857 A1 with a composition as shown in Table 3.

TABLE 3

| Composition of Comparative Polymer CP5 | | | | | | | | |
|---|---|---|---|---|---|---|---|---|
| Polymer # | C17MA/g | MMA/g | SMA/g | CNr | KV100/cSt | Mw/g/mol | PDI | Conc/% |
| CP5 | 45 | 25 | 30 | 8.8 | 1000 | 290 000 | 4.0 | 55 |

Example 2: Preparation of Lubricant Oil Blends

Selected polymers from P1 to P16, CP5 as prepared above and a comb polymer from the market (Viscoplex®12-199) were used for obtaining the lubricating oil compositions B1 to B5, and CB1 to CB2.

As the base oil component Yubase 4 (group III base oil) has been added.

The amounts of the components in blends B1 to B5 and CB1 to CB2 have been as follows:

| | |
|---|---|
| Polymer P1 to P16, CP5, Viscoplex 12-199: | 3.5-9.0 percent by weight |
| Add-pack w/o viscosity index improver VII: | 13 percent by weight |
| Base oil component: | 78-83.5 percent by weight |

The cold crankcase simulation CCS at −35° C. (ASTM D5293) was used to determine apparent viscosity of the oil, that means the low temperature performance of lubricants, e.g. when starting a cold engine (i.e. cold-cranking). Goal was to achieve low CCS apparent viscosities.

The High Temperature High Shear HTHS Viscosity test (CEC L-36-A-90) determines the dynamic viscosity of lubricants at 100° C. (HTHS100) or 150° C. (HTHS150). A small ratio of HTHS100/HTHS150 indicates that a formulation has lower viscosity under operating condition, which results in lower fuel consumption and higher fuel economy.

The evaluation of the mechanical shear stability was made by the low viscosity loss after 30 cycles (CEC L-14-A-93). Preferred is a low viscosity loss.

In one aspect the data showed that the inventive polymers have at the same time a desirable high viscosity index VI and a desirable low CCS apparent viscosity.

TABLE 4

| blend # | | treat rate (solution)/% | treat rate (polymer)/% | KV 100 $mm^2/s$ | VI | HTHS 100/150 | CCS (−35° C.)/mPas | Viscosity loss/% |
|---|---|---|---|---|---|---|---|---|
| B1 | P3 | 6.74 | 2.02 | 7.457 | 191 | 2.01 | 6118 | 0.58 |
| B2 | P5 | 5.00 | 1.50 | 7.418 | 193 | 2.12 | 6071 | 2.48 |
| B3 | P8 | 5.00 | 1.50 | 8.031 | 195 | 2.12 | 6210 | 8.59 |
| B5 | P14 | 5.00 | 1.50 | 7.590 | 198 | 2.09 | 5986 | 3.45 |
| B6 | P16 | 5.00 | 1.50 | 8.658 | 205 | 2.10 | 6229 | 13.63 |
| CB1 | CP5 | 3.87 | 2.13 | 8.045 | 197 | 2.09 | 6567 | 6.84 |
| CB2 | CP6 | 5.00 | 2.00 | 7.357 | 178 | 2.12 | 6213 | 0.16 |

Rheology behavior and other performance characteristics of lubricating oil compositions B1 to B5, and CB1 to CB2 have been measured and summarized in Table 4.

The weight of polymer solution is chosen to reach a high temperature high shear HTHS150 viscosity of 2.6+−0.1 mPas measured according to CEC L-36-A-90. The required amount of the polymer is given in Table 4 as "treat rate (polymer)". A small treat rate (polymer) is desirable, because it reduces the overall costs for the oil. The data showed that the inventive polymer had such low treat rates.

The kinematic viscosity at 100° C. (KV100) of the lubricant was determined according to ASTM D445/446.

The higher the viscosity index VI (DIN ISO 2909), the smaller the effect of temperature on the kinematic viscosity.

The invention claimed is:

1. A lubricating oil composition comprising:

(a) a base oil, (b) a poly(polyisobutylenemethacrylate) copolymer (polyPIBMA) comprising polyisobutylene macromonomers (PIBMA) of formula (I)

(I)

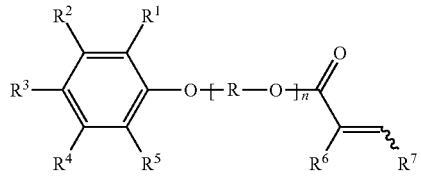

wherein $R^1$ to $R^5$ independently from each other are selected from the group consisting of hydrogen, $C_1$-$C_{20}$-alkyl, $C_1$-$C_{20}$-alkyloxy and $C_8$-$C_{7500}$-polyisobutyl $C_8$-$C_{7500}$-polyisobutenyl, R is an alkylene group comprising 2 to 10 carbon atoms, $R^6$ is hydrogen or methyl, $R^7$ is hydrogen or methyl, or $COOR^8$, $R^8$ is hydrogen or $C_1$-$C_{20}$-alkyl and n is a number from 1 to 50, characterized in that at least one of $R^1$ to $R^5$ is a $C_8$-$C_{7500}$-polyisobutyl or $C_8$-$C_{7500}$-polyisobutenyl, and (c) additives.

2. The lubricating oil composition of claim 1, comprising a) 70 to 99.9 weight percent base oil, b) 0.1 to 50 weight percent of a poly(polyisobutylenemethacrylate) copolymer, c) 0.05 to 20 weight percent of additives.

3. The lubricating oil composition according to claim 1, comprising polyPIBMA, which has a number average of carbon atoms on the side chains of at least 6.

4. The lubricating oil composition according to claim 1, comprising at least one additive selected from the group consisting of antioxidants, oxidation inhibitors, corrosion inhibitors, friction modifiers, metal passivators, rust inhibitors, anti-foamants, viscosity index enhancers, additional pour-point depressants, dispersants, detergents, further extreme-pressure agents and/or anti-wear agents.

5. The lubricating oil composition according to claim 1, having a viscosity loss as measured according to ASTM D6278 of less than 15%.

6. The lubricating oil composition according to claim 1, having a cold crankcase viscosity measured according to ASTM D2293 at −35° C. of less than 6500 mPas.

7. The lubricating oil composition according to claim 1, having a viscosity index of at least 180.

8. The lubricating oil composition according to claim 1, where the poly(polyisobutylenemethacrylate) copolymer comprises 5-50% PIBMA according to formula (I) by weight, 0-50% of methyl(meth)acrylate and 0-80% (meth) acrylate with $C_2$-$C_{22}$ alkyl chains.

9. The lubricating oil composition according to claim 1, where the poly(polyisobutylenemethacrylate) copolymer comprises 10-35% PIBMA according to formula (I) by weight, 20-40% methyl (meth)acrylate, and 25-70% (meth) acrylate with $C_2$-$C_{22}$ alkyl chains.

10. The lubricating oil composition according to claim 1, where exactly one of $R^1$ to $R^5$ is a $C_8$-$C_{7500}$-polyisobutyl or $C_8$-$C_{7500}$-polyisobutenyl.

11. The lubricating oil composition according to claim 1, where the residues $R^1$ to $R^5$, which are not the $C_8$-$C_{7500}$-polyisobutyl or $C_8$-$C_{7500}$-polyisobutenyl, are selected from the group of hydrogen, methyl and tert-butyl.

12. The lubricating oil composition according to claim 1, where R is selected from 1,2-ethylene, 1,2-propylene, 1,2-butylene, 1-phenyl-1,2-ethylene, 2-phenyl-1,2-ethylene.

13. The lubricating oil composition according to claim 1, where n is 1.

14. The lubricating oil composition according to claim 1, wherein the composition is used in an automatic transmission fluid, a manual transmission fluid, a hydraulic fluid, a grease, a gear fluid, a metal-working fluid, a crankcase engine oil or shock absorber fluid.

15. A method for improving the shear stability of a lubricating oil composition, wherein said method comprises the step of adding to a base oil, and an additive, a poly (polyisobutylenemethacrylate) copolymer (polyPIBMA) of formula (I)

(I)

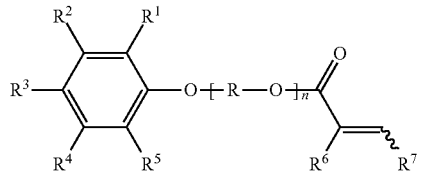

wherein $R^1$ to $R^5$ independently from each other are selected from the group consisting of hydrogen, $C_1$-$C_{20}$-alkyl, $C_1$-$C_{20}$-alkyloxy and $C_8$-$C_{7500}$-polyisobutyl and $C_8$-$C_{7500}$-polyisobutenyl, R is an alkylene group comprising 2 to 10 carbon atoms, $R^6$ is hydrogen or methyl, $R^7$ is hydrogen or methyl, or $COOR^8$, $R^8$ is hydrogen or $C_1$-$C_{20}$-alkyl and n is a number from 1 to 50, characterized in that at least one of $R^1$ to $R^5$ is a $C_8$-$C_{7500}$-polyisobutyl or $C_8$-$C_{7500}$-polyisobutenyl.

16. The lubricating oil composition according to claim 1, wherein R is an alkyl group comprising 2 to 6 carbon atoms.

17. The lubricating oil composition according to claim 1, wherein R is an alkyl group comprising 2 to 4 carbon atoms.

* * * * *